United States Patent [19]

Duclos

[11] Patent Number: 4,508,350

[45] Date of Patent: Apr. 2, 1985

[54] GOLF CLUB HEAD

[76] Inventor: Clovis R. Duclos, 6327 Marina Pacifica Dr., Long Beach, Calif. 90803

[21] Appl. No.: 428,122

[22] Filed: Sep. 29, 1982

[51] Int. Cl.[3] ..... A63B 69/36; A63B 53/04

[52] U.S. Cl. ..... 273/183 D; 273/169

[58] Field of Search ..... 273/169, 171, 167 B, 273/167 F, 167 J, 168

[56] References Cited

U.S. PATENT DOCUMENTS

| | | | |
|---|---|---|---|
| 1,133,129 | 3/1915 | Govan | 273/171 |
| 1,901,562 | 3/1933 | Main | 273/169 |
| 1,993,928 | 3/1935 | Glover | 273/169 |
| 2,198,981 | 4/1940 | Sullivan | 273/171 |
| 3,064,980 | 11/1962 | Steiner | 273/171 |
| 3,652,093 | 3/1972 | Reuter | 273/169 |
| 3,749,408 | 7/1973 | Mills | 273/171 |
| 3,880,430 | 4/1975 | McCabe | 273/169 X |
| 4,010,958 | 3/1977 | Long | 273/169 |
| 4,027,885 | 6/1977 | Rogers | 273/169 |
| 4,076,254 | 2/1978 | Nygren | 273/171 X |

*Primary Examiner*—George J. Marlo

*Attorney, Agent, or Firm*—George W. Finch

[57] ABSTRACT

A golf club putter is constructed with a head having a high polar moment of inertia about its preferred ball striking point by forming the putter head body out of light weight material, such as aluminum, with relatively large heel and toe cavities. A predetermined mass of heavy material such as molten lead is poured into the cavities along with a small amount of uncured epoxy. At the temperature of molten lead, epoxy loses much of its viscosity and flows on the surface of the lead to fill voids caused by contraction of the lead. A thin cover preferably of a decorative material like polished brass then is bonded to a flange formed about each cavity by the epoxy to close each cavity.

3 Claims, 6 Drawing Figures

GOLF CLUB HEAD

BACKGROUND OF THE INVENTION

A golfer using a putter wishes to strike a golf ball in a chosen direction at a right angle to the face of the putter. To assist the golfer in doing this, many clubs include visual alignment devices so that the initial address of the ball can be accurately judged by the golfer. It is also recognized that in some instances when the golf ball is struck by other than the center of percussion or "sweet spot" of the club, a rotation of the face of the club occurs during the time that the miss hit ball is in contact therewith so that the ball leaves the club face in a direction other than that intended by the golfer. To attempt to alleviate this problem, golf clubs have been constructed from steel or brass with shapes which maximizes the metal therein at the heel and the toe so that the club has a large polar moment of inertia. A large polar moment of inertia seems to broaden the "sweet spot" by reducing the tendency of an off-center hit golf ball to rotate the face of the club. The amount of heel of toe weighting that has been accomplished heretofore has been limited to a polar moment of inertia of about 3200 gm $cm^2$ by structural considerations of the club and size and weight limitations thereon. A typical example of these types of clubs are shown in U.S. Pat. No. 4,128,244 and U.S. Pat. No. Des. 263,409 to Clovis R. Duclos and in the Ping Anser, manufactured by Karston Mfg. Corp. Phoenix, Az.

SUMMARY OF THE PRESENT INVENTION

The present putter head has a body formed from light material such as aluminum with large, rearwardly facing cavities provided at the heel and toe thereof. A predetermined weight and molten lead or other suitable heavy material is poured into each of these cavities. Either initially or before the lead cools, freshly mixed but uncured epoxy adhesive is poured in each cavity to fill it. The molten lead liquidfies the epoxy causing it flow around the lead which shrinks as it cools. Epoxy remains on the inner surface of each cavity even though its level decreases as the lead shrinks. A decorative cover plate is positioned on a peripheral flange wet by the epoxy in each cavity before the epoxy has set up to close each of the cavities. The result is a putter, which although not heavier or wider than standard putters, has a polar moment of inertia substantially greater than can be accomplished with solid steel or brass putters. This results in a greatly expanded "sweet spot" so that balls miss hit off of the "sweet spot" have a greatly reduced error angle as they leave the putter's ball striking surface caused by rotation of the club.

It is therefore an object of the present invention to provide an improved putter with a much larger tolerance for miss hit balls than has previously been thought to be possible.

Another object is to provide a lead filled light weight casting whose lead is easily installed with relatively little tooling in a manner which does not come loose in use.

Another object is to provide a high polar moment to a putter which although relatively economical to construct has a pleasing, decorative appearance.

Another object is to provide a method for filling golf clubs with weighting material which can be accomplished with a minimum of tooling and labor.

These and other objects and advantages of the present invention will become apparent to those skilled in the art after considering the following detailed specification together with the accompanying drawing wherein:

DETAILED DESCRIPTION OF THE SHOWN EMBODIMENT

Figure 1:
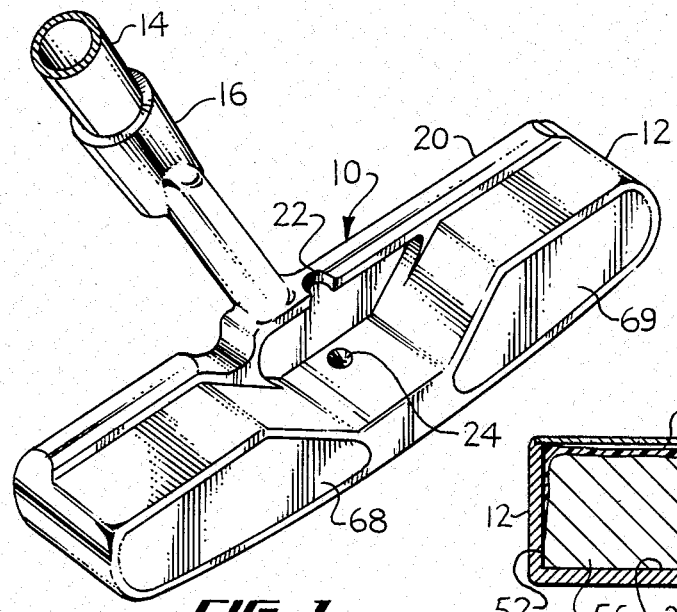
FIG. 1 is a perspective view of the putter head of the present invention.
Figure 2:
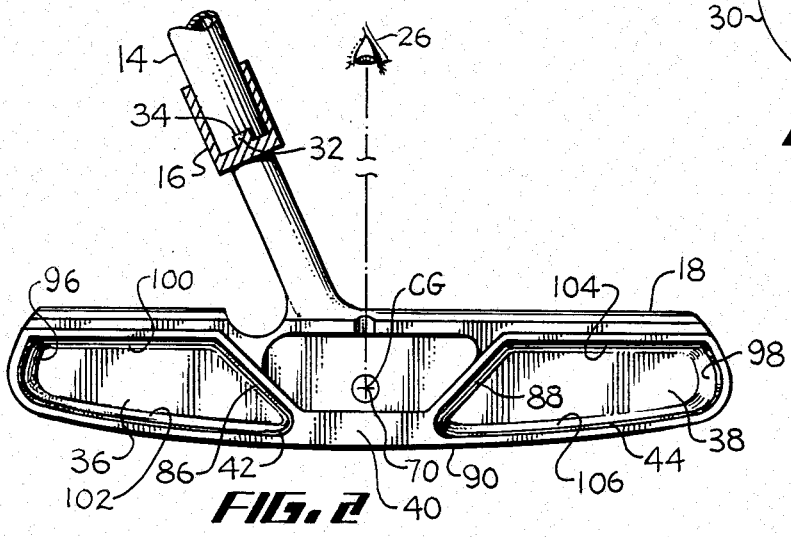
FIG. 2 is a back elevational view of the putter of FIG. 1 with the cavities thereof empty and with the hozel thereof in partial cross-section.

Referring to the drawing more particularly by reference numbers, number 10 in FIG. 1 refers to a golf club putter constructed according to the present invention. The putter includes a head 12 connected to a shaft 14 by means of a hozel 16 forming an integral part of the body casting 18 of the head 12. The hozel 16 is optional as the shaft 14 may be curved and extend directly into the body casting 18. The head 12 includes a front ball striking surface 20 and suitable alignment means such as the notch 22 formed directly above an alignment spot 24 so that the golfer's eye 26, as shown in FIG. 2, can look down vertically through the notch 22 to the spot 24 for horizontal alignment of the swing direction 28 (FIG. 3) with the ball 30. As shown in FIG. 2, the shaft 14 is positively torsionally connected to the hozel 16 by means of a key 32 which fits in a notch 34 in the shaft 14 so that when the shaft 14 is adhesively attached to the hozel 16, the key 32 and notch 34 physically interact to mechanically lock the shaft 14 to the head 12.

Figure 3:
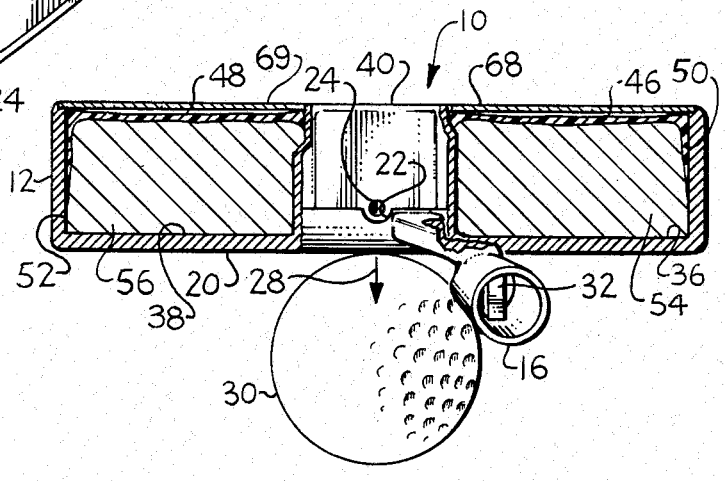
FIG. 3 is a partial cross-sectional top view of the putter of FIG. 1 showing the relationship of lead, epoxy, and decorative cover.

The casting 18 preferably is constructed from a light metallic material, such as aluminum, so that it makes a very small contribution to the overall mass of the head 12. Composite materials can also be used. The casting 18 includes a heel cavity 36 and a toe cavity 38 which, as shown in FIG. 3, extend from just behind the front surface 20 of the head 12 to open through the back surface 40 thereof. The cavities 36 and 38 are ringed adjacent the back surface 40 by peripheral flanges 42 and 44 respectively.

When constructing the head 12, the casting 18 is oriented with its front surface 20 downwardly. A predetermined mass of heavy material, such as lead, in its molten state is poured into each of the cavities 36 and 38. A convenient way of doing this is to place the casting 18 on a scale and monitor the weight increase as the lead pours in. Usually the cavities 36 an 38 define essentially equal volumes and essentially equal amounts of lead are poured in. Before the lead has had time to cool, a small amount of suitable adhesive such as epoxy 46 and 48 in its uncured but mixed state is placed in the cavities 36 and 38 until it just fills the cavities 36 and 38, as shown in FIG. 3, up to the flanges 42 and 44. The epoxy 46 and 48 becomes very liquid when subjected to the temperatures of molten lead. The lead contracts as it cools but the epoxy flows into the enlarging interfaces 50 or 52 to fill any gaps between the casting 18 and the solidifing lead slugs 54 and 56 so that the slugs 54 and 56 are retained in position and do not tend to rattle or come loose in service. The epoxy level recedes but not before it has wet the flanges 42 and 44. Before the epoxy 46 and 48 has had a chance to cure, decorative plates 68 and 69 are placed on the flanges 42 and 44 where the epoxy 46 and 48 bonds them to the casting 18.

Figure 4:
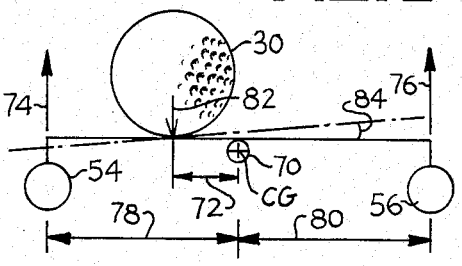
FIG. 4 is a diagrammatic view of the putter of FIGS. 1 through 3 showing the action thereof when a golf ball is miss hit.

Since lead weighs about ten times more per unit volume than aluminum, the head 12 has much more massive heel and toe weighting than is possible when a head is constructed from one type of material. The massive slugs 54 and 56 cause the head 12 to have an extremely high polar moment of inertia, in the range of 4500 gm $cm^2$ for a club head of 310 gms that inertially resists twisting about the center of gravity 70 of the head 12, the center of gravity 70 being positioned by the proper sizing of the cavities 36 and 38, in alignment with the alignment notch 22 and spot 24. Therefore, should a ball be miss hit, as shown diagrammatically in FIG. 4, by being hit off of the center of gravity 70 a distance 72, the relative forces 74 and 76 of the slugs 54 and 56 moving forward times the moment arms 78 and 80 thereof greatly overcome the twisting tendancy caused by the force 82 of the resisting mass of the ball 30 times the distance 72 from the center of gravity 70. Therefor the angle 84 of undesired rotation of the face 20 caused by the miss hit, when the ball 30 is in contact with the face 20, is greatly reduced making a more accurate putt than would be expected otherwise. With the general configuration shown, moments of from 4000 gm $cm^2$ for a light putter head (270 gms) to 5000 gm $cm^2$ for a heavy putter (335 gms) can be provided merely by changing the weight of lead poured in the cavities 36 and 38. This is done without exceeding 4.8 inches (12.192 cm) of head length 85 resulting in a minimum ratio of head length to moment of 328 gm cm.

Figure 6:
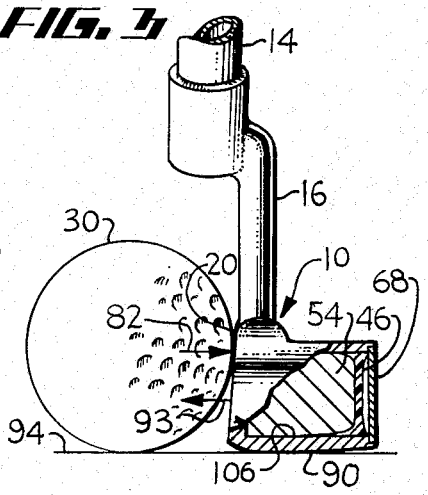
FIG. 6 is a partial cross-sectional side view showing the relationship between center of gravity and impact point on the club face.
Figure 5:
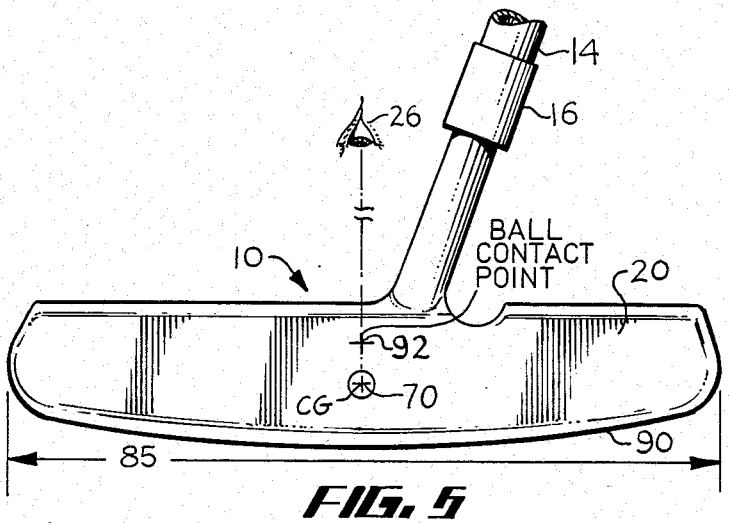
FIG. 5 is a front elevational view of the present invention showing the preferred relationship of the center of gravity, eyesight line and impact point.

Since the cavities 36 and 38 have inner side edges 86 and 88 which slope downwardly toward the sole 90 of the head 12, the center of gravity 70 of the club is relatively low to the sole 90 resulting in a preferred ball contact point 92 located thereabove. Therefore, the force 82 caused by striking the ball 30 with the face 20 and its couple force 93 from the center of gravity 70 tend to rotate the face 20 backwardly or clockwise in the orientation of FIG. 6 so that the sole 90 does not scuff the ground 94 over which it slides while hitting the ball 30. The cavities 36 and 38 also include generally circular outer end surfaces 96 and 98 and generally parallel upper and lower surfaces 100 and 102, and 104 and 106 respectively. The surfaces 86, 88, 96, 98, 100, 102, 104, and 106 are generally perpendicular to the face 20, they being slightly out of perpendicular to provide casting draft angles.

Therefore, there has been shown and described a novel putter and method of construction which fulfills all the objects and advantages sought therefore. Many changes, modifications, variations and other uses and applications of the subject invention will, however, become apparent to those skilled in the art after considering this specification together with the accompanying drawing and claims. All such changes, modifications, variations and other uses and applications which do not depart from the spirit and scope of the invention are deemed to be covered by the invention which is limited only by the claims which follow.

What is claimed is:

1. A golf club head including:

a body casting constructed from material having a first predetermined density, said body casting having:

a front golf ball striking surface;

a heel cavity having cast and adhesively bonded therein a predetermined amount of a material having a second predetermined density substantially more dense than said first predetermined density; and a toe cavity having cast and adhesively bonded therein a predetermined amount of a material having said second predetermined density whereby said head has a high polar moment of inertia to resist turning forces applied to said face; and a back surface through which said heel and toe cavities open, said heel and toe cavities each including:

a peripheral flange formed adjacent said back surface, and said head further including:

a heel plate connected to said heel flange to close said heel cavity at said back surface; and a toe plate connected to said toe flange to close said toe cavity at said back surface, wherein said body further includes:

a sole surface intersecting said front golf ball striking surface; and a center of gravity, said front golf ball striking surface having:

a golf ball striking spot thereon about a golf ball radius above said sole surface, said golf ball striking spot being above said center of gravity.

2. The golf club head as defined in claim 1 wherein said body casting has:

a notch therein in the same vertical plane as said golf ball striking spot; and circular indicia below said notch whereby said circular indicia can be observed through said notch when said golf head is properly aligned with respect to its user.

3. The golf club head as defined in claim 1 wherein said heel and toe cavities include:

front surfaces generally parallel to said front golf ball striking surface;

generally parallel upper and lower surfaces which are generally perpendicular to said front golf ball striking surface;

generally circular outer surfaces which are generally perpendicular to said front golf ball striking surface; and inner surfaces which slant downwardly toward each other and which are generally perpendicular to said front golf ball striking surface.

* * * * *